US009564716B2

(12) United States Patent
Kao et al.

(10) Patent No.: US 9,564,716 B2
(45) Date of Patent: Feb. 7, 2017

(54) ELECTRICAL RECEPTACLE CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Mao-Sheng Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/944,190

(22) Filed: Nov. 17, 2015

(65) Prior Publication Data

US 2016/0149349 A1 May 26, 2016

(30) Foreign Application Priority Data

Nov. 21, 2014 (TW) ..... 103140543 A

(51) Int. Cl.

| | |
|---|---|
| ***H01R 13/6586*** | (2011.01) |
| *H01R 12/72* | (2011.01) |
| *H01R 13/6594* | (2011.01) |
| *H01R 13/6597* | (2011.01) |

(52) U.S. Cl.

CPC ..... *H01R 13/6586* (2013.01); *H01R 12/724* (2013.01); *H01R 13/6594* (2013.01); *H01R 13/6597* (2013.01)

(58) Field of Classification Search

USPC ..... 439/607.05, 607.55, 607.01, 78, 374

See application file for complete search history.

(56) References Cited

U.S. PATENT DOCUMENTS

| | | | | |
|---|---|---|---|---|
| 8,801,462 | B2 * | 8/2014 | Tsai | H01R 12/724 439/607.01 |
| 9,312,644 | B2 * | 4/2016 | Kao | H01R 13/6591 |
| 9,318,856 | B2 * | 4/2016 | MacDougall | H01R 13/6581 |
| 9,337,588 | B2 * | 5/2016 | Chang | H01R 13/6594 |
| 9,350,121 | B2 * | 5/2016 | Ju | H01R 13/6585 |
| 9,350,126 | B2 * | 5/2016 | Little | H01R 24/60 |
| 9,356,400 | B2 * | 5/2016 | Little | H01R 4/023 |
| 9,362,680 | B2 * | 6/2016 | Kao | H01R 13/6583 |
| 9,379,499 | B2 * | 6/2016 | Miyoshi | H01R 24/60 |
| 2010/0267261 | A1 * | 10/2010 | Lin | H01R 13/6461 439/218 |
| 2013/0344739 | A1 * | 12/2013 | Shih | H01R 13/658 439/607.28 |
| 2014/0113481 | A1 * | 4/2014 | Little | H01R 13/64 439/374 |

(Continued)

*Primary Examiner* — Alexander Gilman

(74) *Attorney, Agent, or Firm* — Winston Hsu; Scott Margo

(57) ABSTRACT

A receptacle connector includes an insulation housing bracket, a first flat grounding contact and a shielding member. The housing base has a first outer surface, and the first flat grounding contact is combined with the insulation housing bracket. The shielding member includes a shielding body and a first connecting portion. The shielding body is installed inside the insulation housing bracket, and the first flat grounding contact is located between the first outer surface and the shielding member. The first connecting portion protrudes from the shielding body and is securely fixed on the first grounding contact in a laser welding manner, such that the shielding body is electrically connected to the first grounding contact.

13 Claims, 4 Drawing Sheets

(56) References Cited

U.S. PATENT DOCUMENTS

| | | | | |
|---|---|---|---|---|
| 2014/0194005 | A1* | 7/2014 | Little | H01R 13/6585 439/607.28 |
| 2015/0044886 | A1* | 2/2015 | Little | H01R 12/75 439/55 |
| 2015/0072562 | A1* | 3/2015 | Little | H01R 13/6658 439/607.55 |
| 2015/0171574 | A1* | 6/2015 | Little | H01R 24/60 439/78 |
| 2016/0141804 | A1* | 5/2016 | Kao | H01R 24/60 439/607.01 |
| 2016/0149348 | A1* | 5/2016 | Kao | H01R 13/6585 439/607.05 |
| 2016/0156136 | A1* | 6/2016 | Kao | H01R 13/6585 439/607.05 |

* cited by examiner

ELECTRICAL RECEPTACLE CONNECTOR

BACKGROUND OF THE INVENTION

1. Field of the Invention

The present invention relates to an electrical receptacle connector, and more particularly, to an electrical receptacle connector adapted for a Universal Serial Bus interface and capable of reducing electromagnetic interference.

2. Description of the Prior Art

With the development of computer and peripheral equipment industry, a Universal Serial Bus (USB) interface has become one of important interfaces for communication and data transmission between a computer and peripheral equipment. A conventional USB electrical receptacle connector usually has an electromagnetic interference issue due to improper shielding between flat signal contacts, so as to impact on performance of high frequency transmission of the conventional USB electrical connector. Accordingly, it results in abnormal performance of electronic devices, such as a wireless mouse, a Bluetooth device, a hard disc drive and so on. Therefore, it has become an important topic to design a new USB electrical receptacle connector with shielding configuration for reducing electromagnetic interference.

SUMMARY OF THE INVENTION

The present invention provides an electrical receptacle connector adapted for a Universal Serial Bus (USB) interface and capable of reducing electromagnetic interference for solving above drawbacks.

According to the claimed invention, a receptacle electrical connector includes a shell, an insulation housing bracket, at least one first flat grounding contact, and a shielding member. The insulation housing bracket is disposed in the shell and has a first outer surface. The at least one first flat grounding contact is disposed in the insulation housing bracket. A portion of the at least one first flat grounding contact is exposed on the first outer surface. The shielding member includes a shielding body and a first connecting portion. The shielding body is disposed in the insulation housing bracket. The at least one first flat grounding contact is located between the first outer surface and the shielding body. The first connecting portion protrudes from the shielding body. The first connecting portion is fixed onto the first flat grounding contact in a laser welding manner, such that the shielding body is electrically connected to the first flat grounding contact.

According to the claimed invention, the insulation housing bracket has a second outer surface opposite to the first outer surface. The shielding member is located between the first outer surface and the second outer surface. The receptacle electrical connector further includes at least one second flat grounding contact disposed in the insulation housing bracket and exposed on the second outer surface. The shielding member includes a second connecting portion protruding from a side of the shielding body and opposite to the first connecting structure, and the second connecting portion is fixed onto the second flat grounding contact in a laser welding manner, such that the shielding body is electrically connected to the second flat grounding contact.

According to the claimed invention, the insulation housing bracket includes a first insulator and a second insulator. The first insulator is for fixing the first flat grounding contact. The first outer surface is on the first insulator. The second insulator is for fixing the second flat grounding contact. The second outer surface is on the second insulator. The first insulator is detachably installed on the second insulator, and the first insulator and the second insulator cooperatively clamp the shielding member.

According to the claimed invention, a channel is formed on the first insulator and located corresponding to the first connecting portion, and the first connecting portion is welded onto the first flat grounding contact via the channel.

According to the claimed invention, the channel includes a first channel portion and a second channel portion. The first channel portion is open on the first outer surface and communicates with the second channel portion. The first flat grounding contact has a first welding surface and a second welding surface opposite to the first welding surface. The first welding surface is exposed on the first outer surface via the first channel portion, and the second welding surface is exposed via the second channel portion.

According to the claimed invention, the first connecting portion is a stamping protrusion integrally formed with the shielding body and connected to the second welding surface of the first flat grounding contact via the second channel portion.

According to the claimed invention, a passage is open on the second insulator and located corresponding to the second connecting portion, and the second connecting portion is welded onto the second flat grounding contact via the passage.

According to the claimed invention, an end of the passage is open on the second outer surface. The second flat grounding contact has a first melting surface and a second melting surface opposite to the first melting surface, and the first melting surface is exposed on the second outer surface via the passage.

According to the claimed invention, the second connecting portion is a stamping protrusion integrally formed with the shielding body and connected to the second melting surface of the second flat grounding contact via the passage.

According to the claimed invention, the receptacle electrical connector further includes an upper grounding member and a lower grounding member. The upper grounding member is installed on the first outer surface of the first insulator. The lower grounding member is installed on the second outer surface of the second insulator.

According to the claimed invention, the shell includes a first shell and a second shell. The first shell is fixed on a circuit board. The second shell is fixed on the first shell. An accommodating space is enclosed by the second shell and for containing the insulation housing bracket.

According to the claimed invention, the first shell includes a housing portion and a welding foot portion. The housing portion is fixed onto the second shell in a riveting manner. The welding foot portion protrudes from the housing portion and embedding into the circuit board.

According to the claimed invention, the first shell further includes an engaging protrusion formed on the housing portion. An engaging slot is formed on the second shell, and the engaging protrusion engages with the engaging slot.

According to the claimed invention, the shielding member further includes a latching structure, a grounding portion, and a fixing portion. The latching structure extends from the shielding body and is for latching a plug electrical connector. The grounding portion extends from the shielding body and is located on a side opposite to the latching structure. The fixing portion protrudes from the shielding body and is located between the latching structure and the grounding portion. The fixing portion is fixed onto the circuit board.

According to the claimed invention, the insulation housing bracket has a second outer surface opposite to the first outer surface. The receptacle electrical connector further includes at least one second flat grounding contact, a first flat signal contact set, and a second flat signal contact set. The at least one second flat grounding contact is disposed in the insulation housing bracket and exposed on the second outer surface. The first flat signal contact set is arranged alongside the at least one first flat grounding contact. The at least one first flat grounding contact is disposed on two opposite lateral sides of the first flat signal contact set. The second flat signal contact set is arranged alongside the at least one second flat grounding contact. The at least one second flat grounding contact is disposed on two opposite lateral sides of the second flat signal contact set.

According to the claimed invention, each of the first flat signal contact set and the second flat signal contact set includes at least two pairs of differential signal contacts. The differential signal contacts of the first flat signal contact is symmetric to the differential signal contacts of the second flat signal contact set by rotation of 180 degrees along a front-back direction of the electrical receptacle connector.

In summary, the present invention utilizes the first connecting portion and the second connecting portion of the shielding member for fixing on the first flat grounding contact and the second flat grounding contact respectively (e.g., by welding), such that the shielding member is electrically connected to the first flat grounding contact and the second flat grounding contact. Accordingly, electromagnetic noise on the shielding member can be grounded via the first flat grounding contact and the second flat grounding contact for producing a shielding effect, so as to prevent electromagnetic interface and crosstalk between the flat signal contact sets of the electrical receptacle connector, which improves performance of transmission of signals with high frequency of the electrical receptacle connector.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
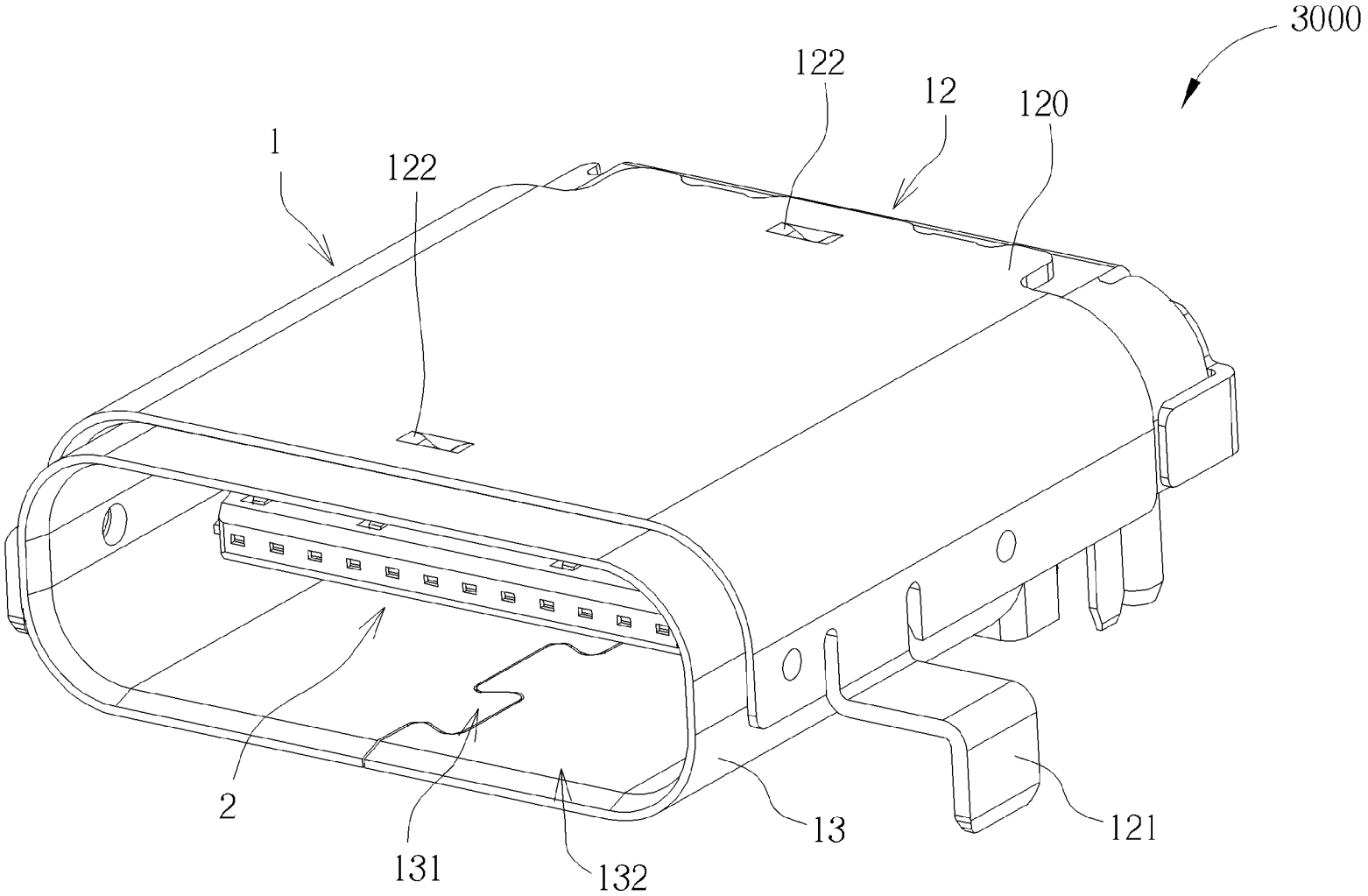
FIG. 1 is a schematic diagram of an electrical receptacle connector according to an embodiment of the present invention.
Figure 2:
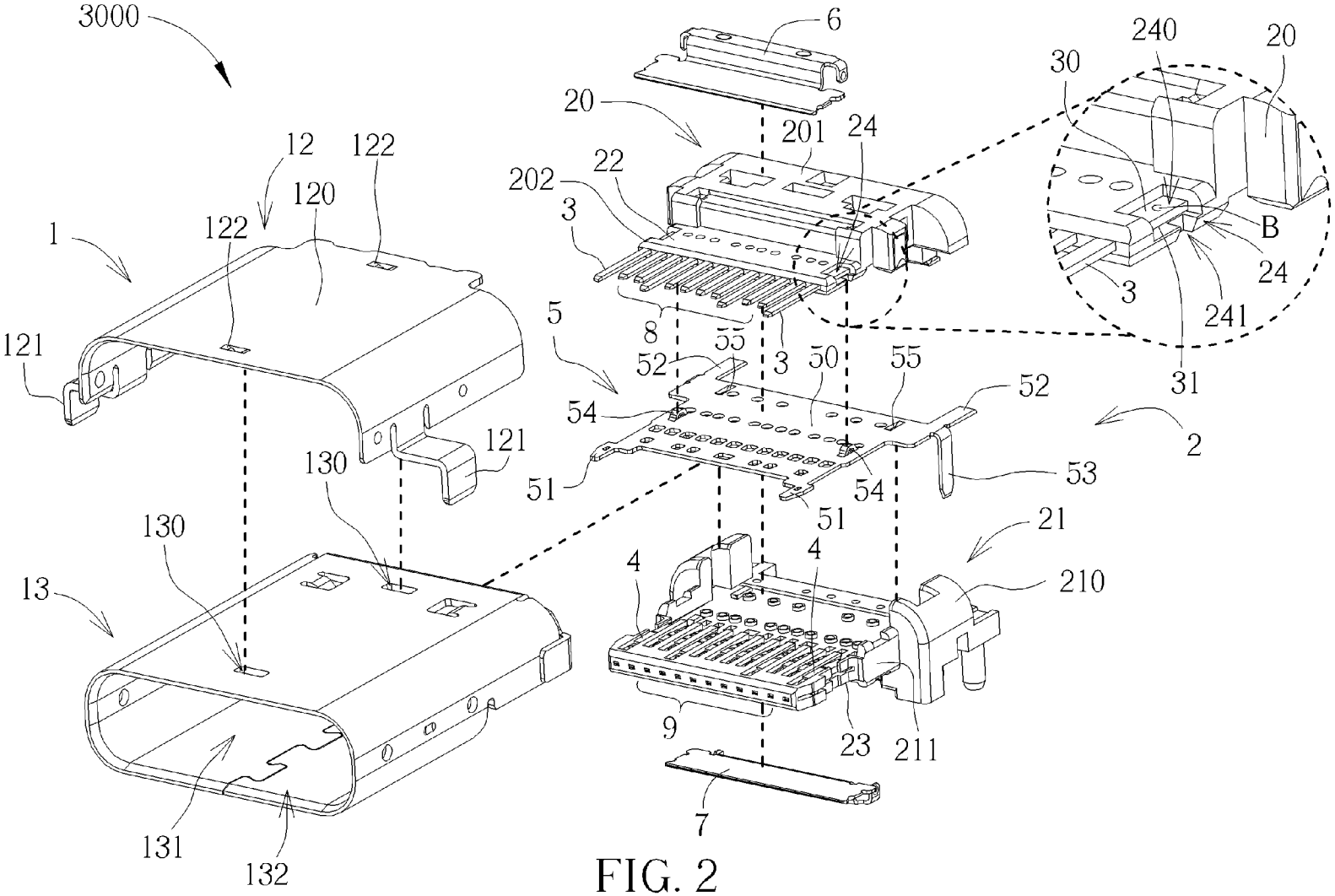
FIG. 2 is an exploded diagram of the electrical receptacle connector according to the embodiment of the present invention.
Figure 3:
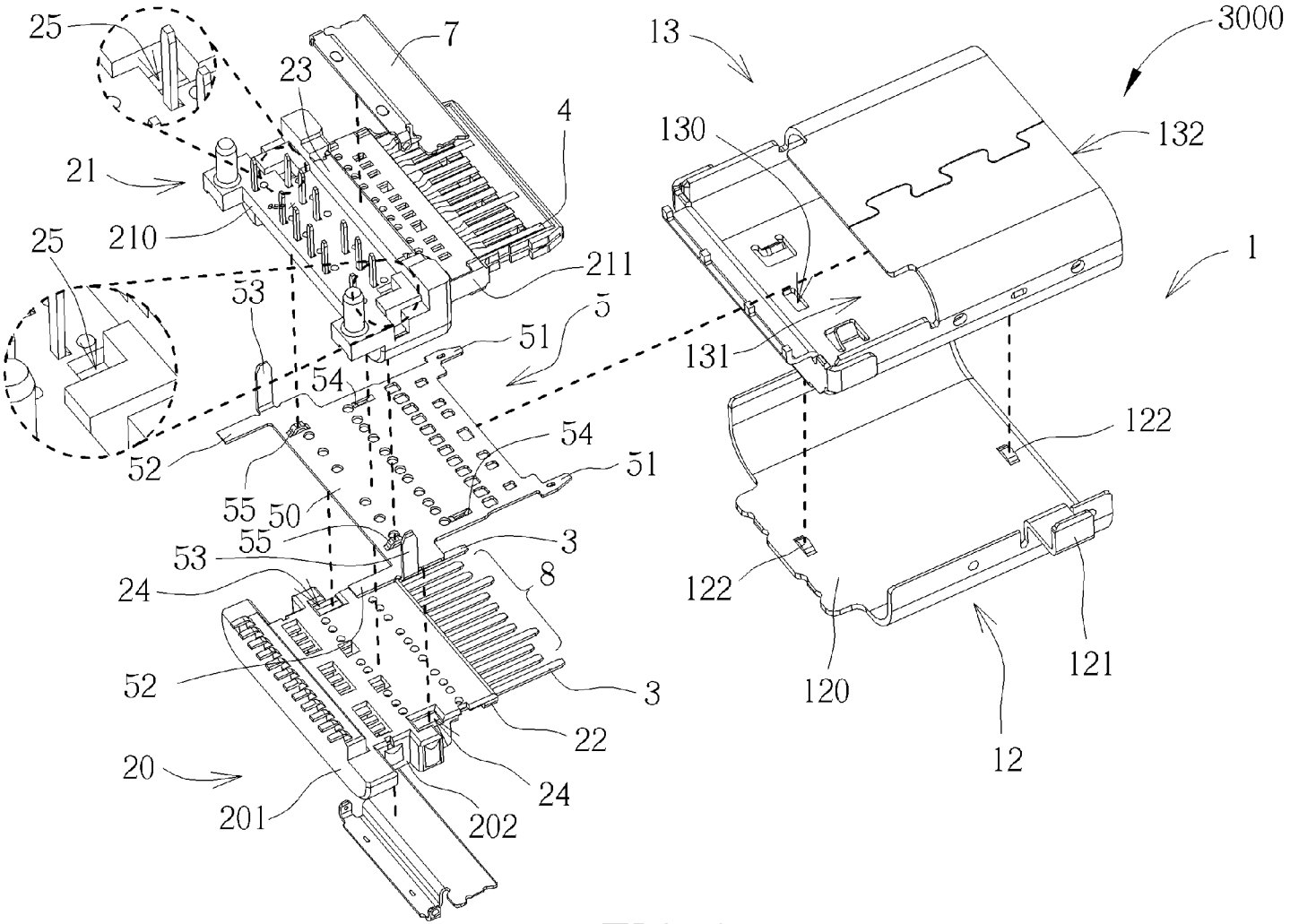
FIG. 3 is an exploded diagram of the electrical receptacle connector in another view according to the embodiment of the present invention.

Please refer to FIG. 1 to FIG. 3. FIG. 1 is a schematic diagram of an electrical receptacle connector 3000 according to an embodiment of the present invention. FIG. 2 is an exploded diagram of the electrical receptacle connector 3000 according to the embodiment of the present invention. FIG. 3 is an exploded diagram of the electrical receptacle connector 3000 in another view according to the embodiment of the present invention. As shown in FIG. 1 to FIG. 3, the electrical receptacle connector 3000 includes a shell 1, an insulation housing bracket 2, two first flat grounding contacts 3, two second flat grounding contacts 4, a shielding member 5, an upper grounding member 6, and a lower grounding member 7. In this embodiment, the insulation housing bracket 2 can include a first insulator 20 and a second insulator 21. The first insulator 20 is detachably installed on the second insulator 21. When the first insulator 20 is installed on the second insulator 21, the first insulator 20 and the second insulator 21 cooperatively form the insulation housing bracket 2.

Furthermore, the electrical receptacle connector 3000 further includes a first flat signal contact set 8 and a second flat signal contact set 9. Each of the first flat signal contact set 8 and the second flat signal contact set 9 includes at least two pairs of differential signal contacts. The differential signal contacts of the first flat signal contact set 8 is symmetric to the differential signal contacts of the second flat signal contact set 9 by rotation of 180 degrees around a front back direction of the electrical receptacle connector 3000.

The insulation housing bracket 2 has a first outer surface 22 and a second outer surface 22 opposite to the first outer surface 22. The first outer surface 22 is on the first insulator 20, and the second outer surface 23 is on the second insulator 21. In addition, the first insulator 20 includes a first base portion 201 and a first tongue portion 202. Fixing portions of the first flat grounding contact 3 and the first flat signal contact set 8 are disposed inside the first base portion 201. Flat portions of the first flat grounding contact 3 and the first flat signal contact set 8 extend forwardly from the fixing portions thereof along the front back direction of the electrical receptacle connector 3000. The flat portions of the first flat grounding contact 3 and the first flat signal contact set 8 are exposed on the first outer surface 22, i.e., a portion of the first flat grounding contact 3 and a portion of the first signal contact set 8 are exposed on the first outer surface 22. Welding portions of the first flat grounding contact 3 and the first flat signal contact set 8 extend downwardly from the fixing portions thereof along the front back direction of the electrical receptacle connector 3000. The second insulator 21 includes a second base portion 210 and a second tongue portion 211. Fixing portions of the second flat grounding contact 4 and the second flat signal contact set 9 are disposed inside the second base portion 210. Flat portions of the second flat grounding contact 4 and the second flat signal contact set 9 extend forwardly from the fixing portions thereof along the front back direction of the electrical receptacle connector 3000. The flat portions of the second flat grounding contact 4 and the second flat signal contact set 9 are exposed on the second outer surface 23, i.e., a portion of the second flat grounding contact 4 and a portion of the second signal contact set 9 are exposed on the second outer surface 23. Welding portions of the second flat grounding contact 4 and the second flat signal contact set 9 extend downwardly from the fixing portions thereof along the front back direction of the electrical receptacle connector 3000.

Figure 4:
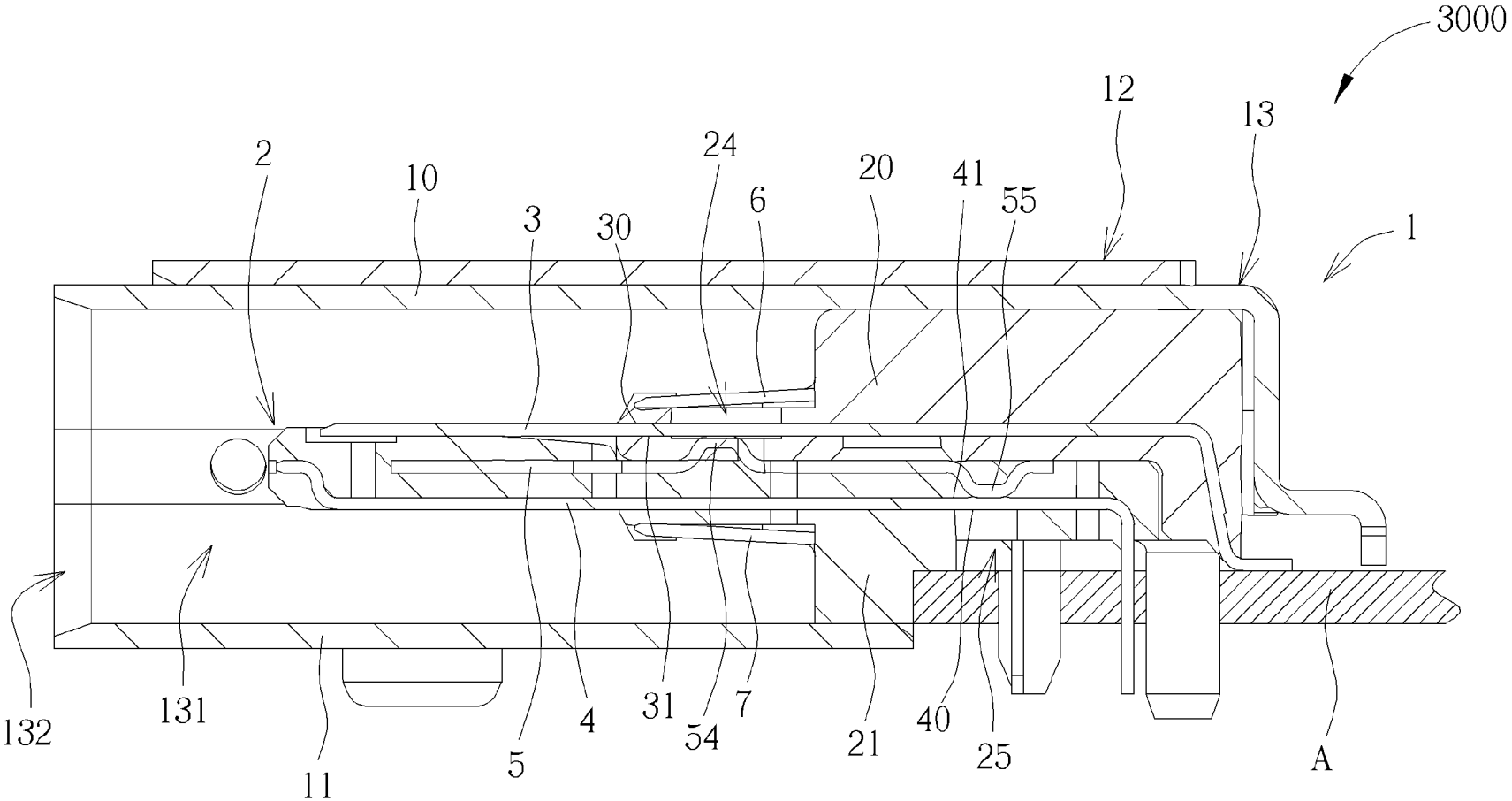
FIG. 4 is a sectional diagram of the electrical receptacle connector according to the embodiment of the present invention.

Please refer to FIG. 1 to FIG. 4. FIG. 4 is a sectional diagram of the electrical receptacle connector 3000 according to the embodiment of the present invention. As shown in FIG. 1 to FIG. 4, the insulation housing bracket 2 is enclosed by the shell 1. In this embodiment, the first flat grounding contact 3 and the first insulator 20 of the insulation housing bracket 2 are integrally formed, such that the first flat grounding contact 3 is combined with the first insulator 20 of the insulation housing bracket 2. The second flat grounding contact 4 and the second insulator 21 of the insulation housing bracket 2 are integrally formed, such that the second flat grounding contact 4 is combined with the second insulator 21 of the insulation housing bracket 2.

Furthermore, when the first insulator 20 is installed on the second insulator 21, the first insulator 20 and the second insulator 21 can cooperatively clamp the shielding member 5, such that the shielding member 5 is able to be fixed between the first flat grounding contact 3 and the second flat grounding contact 4 by the first insulator 20 and the second insulator 21. As shown in FIG. 4, when the first insulator 20 is installed on the second insulator 21, the first flat grounding contact 3 is located between the first outer surface 22 of the insulation housing bracket 2 and the shielding member 5, and the second flat grounding contact 4 is located between the second outer surface 23 of the insulation housing bracket 2 and the shielding member 5.

In addition, the upper grounding member 6 is installed on the first outer surface 22 of the insulation housing bracket 2 (i.e., the first insulator 20) and located between the first outer surface 22 and a top wall 10 of the shell 1. The lower grounding member 7 is installed on the second outer surface 23 of the insulation housing bracket 2 (i.e., the second insulator 21) and located between the second outer surface 23 and a bottom wall 11 of the shell 1. The top wall 10 and the bottom wall 11 are two opposite walls of the shell 1. Besides, the first flat signal contact set 8 is disposed inside the first insulator 20 and arranged alongside the two first flat grounding contacts 3. The two first flat grounding contacts 3 are located on two opposite lateral sides of the first flat signal contact set 8, respectively. The second flat signal contact set 9 is disposed inside the second insulator 21 and arranged alongside the two second flat grounding contacts 4. The two second flat grounding contacts 4 are located on two opposite lateral sides of the second flat signal contact set 9, respectively. When the first insulator 20 is installed on the second insulator 21, the shielding member 5 is clamped by the first insulator 20 and the second insulator 21 and located between the first flat signal contact set 8 and the second flat signal contact set 9. In such a way, the shielding member 5 is able to shield the first flat signal contact set 8 and the second flat signal contact set 9 for prevention of electromagnetic interference and crosstalk when the electrical receptacle connector 3000 transmits signals.

In this embodiment, the electrical receptacle connector 3000 is a Universal Serial Bus (USB) Type-C electrical receptacle connector. The first flat signal contact set 8 and the second flat signal contact set 9 can provide signals satisfying a specification of USB 3.0 or USB 3.1. It should be noted that each of the upper grounding member 6 and the lower grounding member 7 can be an Electro Magnetic Interference (EMI) shielding spring member of the USB Type-C electrical receptacle connector, and the shielding member 5 can be a shielding plate of the USB Type-C electrical receptacle connector. The EMI shielding spring members (i.e., the upper grounding member 6 and the lower grounding member 7) are respectively disposed on a top side and a bottom side (i.e., the first outer surface 22 and the second outer surface 23) of the insulation housing bracket 2 of the USB Type-C electrical receptacle connector (i.e., the electrical receptacle connector 3000). The shielding plate (i.e., the shielding member 5) is held inside the insulation housing bracket 2 of the USB Type-C electrical receptacle connector and located between flat signal contacts (i.e., the first flat signal contact set 8 and the second flat signal contact set 9) of the USB Type-C electrical receptacle connector.

When the USB Type-C electrical receptacle connector (i.e., the electrical receptacle connector 3000) transmits signals with high frequency, the EMI shielding spring members (i.e., the upper grounding member 6 and the lower grounding member 7) are used for shielding the flat signal contacts (i.e., the first flat signal contact set 8 and the second flat signal contact set 9) and the shell 1 of the USB Type-C electrical receptacle connector, and the shielding plate (i.e., the shielding member 5) is used for shielding flat signal contacts for prevention of electromagnetic interference between the flat signal contacts. In such a way, when the USB Type-C electrical receptacle connector transmits signals with high frequency, the EMI shielding spring member and the shielding plate reduces electromagnetic noise and electromagnetic interference, so as to improve performance of transmission between the USB Type-C electrical receptacle connector and a corresponding electrical plug connector with high frequency, which ensures normal performance of an electronic component, such as a wireless mouse, a Bluetooth device, a hard disc drive and so on, coupled to the USB Type-C electrical receptacle connector and the corresponding electrical plug connector.

As shown in FIG. 1 to FIG. 4, the shell 1 includes a first shell 12 and a second shell 13. The second shell 13 is fixed on the first shell 12. Furthermore, the first shell 12 includes a housing portion 120 and a welding foot portion 121. The welding foot portion 121 protrudes from the housing portion 120. In this embodiment, the housing portion 120 is fixed onto the second shell 13 in a riveting manner, but the present invention is not limited to thereto. For example, the first shell 12 can further include an engaging protrusion 122 formed on the housing portion 120 as well (e.g. the engaging protrusion 122 can be a stamping structure). An engaging slot 130 can be formed on the second shell 13. The engaging protrusion 122 is for engaging with the engaging slot 130 so as to fix the housing portion 120 of the first shell 12 onto the second shell 13. As for which one of the above-mentioned designs is adopted, it depends on practical demands.

In addition, the welding foot portion 121 embeds into and is welded on a circuit board A, such that the housing portion 120 is fixed onto the circuit board A. Accordingly, the first shell 12 and the second shell 13 of the shell 1 can be fixed onto the circuit board A together. Furthermore, an accommodating space 131 and a mating opening 132 are enclosed by the second shell 13. The accommodating space 131 is for containing the insulation housing bracket 2 and communicates with an outer side of the second shell 13 via the mating opening 132, such that the electrical plug connector is able to be inserted into the accommodating space 131 via the mating opening 132.

Besides, the shielding member 5 includes a shielding body 50, a latching structure 51, a grounding portion 52, and a fixing portion 53. The shielding body 50 is disposed in the insulation housing bracket 2. The first flat grounding contact 3 is located between the first outer surface 22 and the shielding member 5, i.e., the shielding body 50 is located between the first outer surface 22 and the second outer surface 23. The latching structure 51 extends from the shielding body 50. The grounding portion 52 extends from a side of the shielding body 50 and is located opposite to the latching structure 51. The fixing portion 53 protrudes from the shielding body 50 and located between the latching structure 51 and the grounding portion 52. The fixing portion 53 is fixed onto the circuit board A, and the grounding portion 52 is coupled to a ground end of the circuit board A, such that the shielding body 50 of the shielding member 5 is electrically connected to the ground end of the circuit board A. Furthermore, when the electrical plug connector is mated with the electrical receptacle connector 3000, the latching structure 51 is fixed on a shielding plate (not shown in figures) of the electrical plug connector. Accordingly, the latching structure 51 is capable of not only ensuring mating connection between the electrical plug connector and the electrical receptacle connector 3000 but also electrically connecting the shielding body 50 of the shielding member 5 of the electrical receptacle connector 3000 with the shielding plate of the electrical plug connector. In such a way, when the electrical plug connector is mated with the electrical receptacle connector 3000, grounding path between the electrical plug connector 5000 and the electrical receptacle connector 3000 can be established for improving a grounding effect.

As shown in FIG. 2 to FIG. 4, the shielding member 5 further includes a first connecting portion 54 protruding from the shielding body 50. A channel 24 is formed on the first insulator 20 of the insulation housing bracket 2 and located corresponding to the first connecting portion 54. Furthermore, the channel 24 includes a first channel portion 240 and a second channel portion 241. The first channel portion 240 is open on the first outer surface 22 of the first insulator 20 and communicates with the second channel portion 241. The first flat grounding contact 3 has a first welding surface 30 and a second welding surface 31 opposite to the first welding surface 30. The first welding surface 30 is exposed on the first outer surface 22 via the first channel portion 240, and the second welding surface 31 is exposed via the second channel portion 241.

In this embodiment, the first connecting portion 54 is a stamping protrusion. In practical application, the stamping protrusion (i.e., the first connecting portion 54) is integrally formed with the shielding body 50 in a stamping manner. When the first flat grounding contact 3 and the shielding member 5 are disposed in the insulation housing bracket 2 by the first insulator 20 and the second insulator 21, the stamping protrusion is connected to the second welding surface 31 of the first flat grounding contact 3 via the second channel portion 241. Afterwards, the first connecting portion 54 is fixed from the first outer surface 22 onto the second welding surface 31 of the first flat grounding contact 3 in a laser welding manner via the first channel portion 240 of the channel 24. For example, a laser welding machine (not shown in figures) can be utilized for emitting a laser beam to a welding point B shown in FIG. 2. Since the first connecting portion 54 has abutted against the second welding surface 31 of the first flat grounding contact 3 in advance, the welding point B of the first flat grounding contact 3 is heated by the laser beam, such that the first connecting portion 54 and the first flat grounding contact 3 are melted and welded to each other. In such a way, the shielding body 50 of the shielding member 5 is electrically connected to the first flat grounding contact 3, such that electromagnetic noise on the shielding member 5 is grounded via the first flat grounding contact 3 for producing a shielding effect when the first flat signal contact set 8 and the second flat signal contact set 9 transmit signals.

As shown in FIG. 2 to FIG. 4, the shielding member 5 further includes a second connecting portion 55 protruding from a side of the shielding body 50 and opposite to the first connecting portion 54. A passage 25 is formed on the second insulator 21 of the insulation housing bracket 2 and located corresponding to the second connecting portion 55. Furthermore, an end of the passage 25 is open on the second outer surface 23 of the second insulator 21. The second flat grounding contact 4 has a first melting surface 40 and a second melting surface 41 opposite to the first melting surface 40, and the first melting surface 40 is exposed on the second outer surface 23 via the passage 25. In this embodiment, the second connecting portion 55 is a stamping protrusion. In practical application, the stamping protrusion (i.e., the second connecting portion 55) is integrally formed with the shielding body 50 in a stamping manner. When the second flat grounding contact 4 and the shielding member 5 are disposed in the insulation housing bracket 2 by the first insulator 20 and the second insulator 21, the stamping structure is connected to the second melting surface 41 of the second flat grounding contact 4 via the passage 25. Afterwards, the second connecting portion 55 is fixed on the second melting surface 41 of the second flat grounding contact 4 in a laser welding manner via the passage 25 on the second melting surface 41. In such a way, the shielding body 50 of the shielding member 5 is electrically connected to the second flat grounding contact 4, such that electromagnetic noise on the shielding member 5 are grounded for producing a shielding effect when the first flat signal contact set 8 and the second flat signal contact set 9 transmit signals.

In contrast to the prior, the present invention utilizes the first connecting portion and the second connecting portion of the shielding member for fixing on the first flat grounding contact and the second flat grounding contact respectively (e.g., by welding), such that the shielding member is electrically connected to the first flat grounding contact and the second flat grounding contact. Accordingly, electromagnetic noise on the shielding member can be grounded via the first flat grounding contact and the second flat grounding contact for producing a shielding effect, so as to prevent electromagnetic interface and crosstalk between the flat signal contact sets of the electrical receptacle connector, which improves performance of transmission of signals with high frequency of the electrical receptacle connector.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A receptacle electrical connector, comprising:

a shell;

an insulation housing bracket disposed in the shell and having a first outer surface and a second outer surface opposite to the first outer surface;

at least one first flat grounding contact disposed in the insulation housing bracket, a portion of the at least one first flat grounding contact being exposed on the first outer surface;

at least one second flat grounding contact disposed in the insulation housing bracket and exposed on the second outer surface; and a shielding member located between the first outer surface and the second outer surface, the shielding member comprising:

a shielding body disposed in the insulation housing bracket, the at least one first flat grounding contact being located between the first outer surface and the shielding body;

a first connecting portion protruding from the shielding body, the first connecting portion being fixed onto the first flat grounding contact in a laser welding manner, such that the shielding body is electrically connected to the first flat grounding contact; and wherein the insulation housing bracket further comprises:

a first insulator for fixing the first flat grounding contact, wherein the first outer surface is on the first insulator, a channel is formed on the first insulator and located corresponding to the first connecting portion, the channel comprises a first channel portion and a second channel portion, the first channel portion is open on the first outer surface, the first flat grounding contact has a first welding surface and a second welding surface opposite to the first welding surface, the first welding surface is exposed on the first outer surface via the first channel portion, and the second welding surface is exposed via the second channel portion, and the first connecting portion is welded onto the first flat grounding contact via the first channel portion and the second channel portion; and a second insulator for fixing the second flat grounding contact, wherein the second outer surface is on the second insulator, the first insulator is detachably installed on the second insulator, and the first insulator and the second insulator cooperatively clamp the shielding member.

2. The receptacle electrical connector of claim 1, wherein the shielding member comprises a second connecting portion protruding from a side of the shielding body and opposite to the first connecting portion, and the second connecting portion is fixed onto the second flat grounding contact in a laser welding manner, such that the shielding body is electrically connected to the second flat grounding contact.

3. The receptacle electrical connector of claim 1, wherein the first connecting portion is a stamping protrusion integrally formed with the shielding body and connected to the second welding surface of the first flat grounding contact via the second channel portion.

4. The receptacle electrical connector of claim 1, wherein a passage is formed on the second insulator and located corresponding to the second connecting portion, and the second connecting portion is welded onto the second flat grounding contact via the passage.

5. The receptacle electrical connector of claim 4, wherein an end of the passage is open on the second outer surface, the second flat grounding contact has a first melting surface and a second melting surface opposite to the first melting surface, and the first melting surface is exposed on the second outer surface via the passage.

6. The receptacle electrical connector of claim 5, wherein the second connecting portion is a stamping protrusion integrally formed with the shielding body and connected to the second melting surface of the second flat grounding contact via the passage.

7. The receptacle electrical connector of claim 1, further comprising:

an upper grounding member installed on the first outer surface of the first insulator; and a lower grounding member installed on the second outer surface of the second insulator.

8. The receptacle electrical connector of claim 1, wherein the shell comprises:

a first shell fixed on a circuit board; and a second shell fixed on the first shell, an accommodating space being enclosed by the second shell and for containing the insulation housing bracket.

9. The receptacle electrical connector of claim 8, wherein the first shell comprises:

a housing portion fixed onto the second shell in a riveting manner; and a welding foot portion protruding from the housing portion and embedding into the circuit board.

10. The receptacle electrical connector of claim 9, wherein the first shell further comprises an engaging protrusion formed on the housing portion, an engaging slot is formed on the second shell, and the engaging protrusion engages with the engaging slot.

11. The receptacle electrical connector of claim 8, wherein the shielding member further comprises:

a latching structure extending from the shielding body and being for latching a plug electrical connector;

a grounding portion extending from the shielding body and being located on a side opposite to the latching structure; and a fixing portion protruding from the shielding body and being located between the latching structure and the grounding portion, the fixing portion being fixed onto the circuit board.

12. The receptacle electrical connector of claim 1, wherein the insulation housing bracket has a second outer surface opposite to the first outer surface, and the receptacle electrical connector further comprises:

a first flat signal contact set arranged alongside the at least one first flat grounding contact, the at least one first flat grounding contact being disposed on two opposite lateral sides of the first flat signal contact set; and a second flat signal contact set arranged alongside the at least one second flat grounding contact, the at least one second flat grounding contact being disposed on two opposite lateral sides of the second flat signal contact set.

13. The receptacle electrical connector of claim 12, wherein each of the first flat signal contact set and the second flat signal contact set comprises at least two pairs of differential signal contacts, the differential signal contacts of the first flat signal contact is symmetric to the differential signal contacts of the second flat signal contact set by rotation of 180 degrees along a front-back direction of the electrical receptacle connector.

* * * * *